US009500046B2

(12) United States Patent
Cain et al.

(10) Patent No.: US 9,500,046 B2
(45) **Date of Patent: *Nov. 22, 2016**

(54) SYSTEM FOR CONVEYING FLUID FROM AN OFFSHORE WELL

(71) Applicant: Cameron International Corporation, Houston, TX (US)

(72) Inventors: David Cain, Houston, TX (US); William Puccio, Houston, TX (US); Shian Chou, Houston, TX (US)

(73) Assignee: Cameron International Corporation, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/835,972

(22) Filed: Aug. 26, 2015

(65) Prior Publication Data

US 2015/0361734 A1 Dec. 17, 2015

Related U.S. Application Data

(63) Continuation of application No. 13/559,375, filed on Jul. 26, 2012, now Pat. No. 9,133,670.

(51) Int. Cl.

| | |
|---|---|
| ***E21B 7/12*** | (2006.01) |
| ***E21B 19/00*** | (2006.01) |
| ***E21B 17/01*** | (2006.01) |
| ***E21B 19/10*** | (2006.01) |
| ***E21B 33/06*** | (2006.01) |

(52) U.S. Cl.

CPC ..... *E21B 19/004* (2013.01); *E21B 7/12* (2013.01); *E21B 17/01* (2013.01); *E21B 19/002* (2013.01); *E21B 19/10* (2013.01); *E21B 33/06* (2013.01)

(58) Field of Classification Search

CPC ..... E21B 19/004; E21B 19/006

See application file for complete search history.

(56) References Cited

U.S. PATENT DOCUMENTS

| | | | |
|---|---|---|---|
| 4,059,148 | A | 11/1977 | Blomsma |
| 6,273,193 | B1 | 8/2001 | Hermann et al. |
| 7,188,677 | B2 | 3/2007 | Moe |

(Continued)

FOREIGN PATENT DOCUMENTS

| | | |
|---|---|---|
| WO | 0177483 | 10/2001 |

OTHER PUBLICATIONS

International Search Report and Written Opinion of PCT Application No. PCT/US2013/051659 dated Oct. 16, 2013: pp. 1-10.

*Primary Examiner* — Matthew R Buck
*Assistant Examiner* — Aaron Lembo
(74) *Attorney, Agent, or Firm* — Chamberlain Hrdlicka

(57) ABSTRACT

The riser system of the present invention includes an external production riser for floating structures with interfaces to the dry and subsea wellheads, internal tieback riser with a special lower overshot/slipping connector for elevated temperatures. The seals can be metallic and/or non-metallic dynamic seals. Special centralizing pipe connectors and a special subsea wellhead tubing hanger are also included. This riser system avoids the penalty of pipe within pipe differential thermal growth and the resulting unwanted effects on the floating structure. This is accomplished by allowing an overshot sealing slipping connector to swallow an expanding polished rod as thermal conditions cause pipe elongation axially. When elevated temperatures fall to ambient the opposite occurs as the pipe shrinks axially. Alternatively, a system is possible where a two pipe drilling riser is needed. The internal pipe in this case would be an inner riser rather than a tubing string.

21 Claims, 7 Drawing Sheets

(56) References Cited

U.S. PATENT DOCUMENTS

| | | | |
|---|---|---|---|
| 7,231,981 | B2 | 6/2007 | Moe et al. |
| 7,328,741 | B2 | 2/2008 | Allen et al. |
| 7,658,228 | B2 | 2/2010 | Moksvold |
| 7,866,399 | B2 | 1/2011 | Kozicz et al. |
| 8,037,938 | B2 | 10/2011 | de Azevedo et al. |
| 8,573,307 | B2 | 11/2013 | Moksvold |
| 2004/0052586 | A1 | 3/2004 | Horton, III |
| 2006/0011348 | A1 | 1/2006 | Fenton et al. |
| 2011/0005767 | A1 | 1/2011 | Muff et al. |
| 2013/0153240 | A1 | 6/2013 | Puccio et al. |
| 2013/0230358 | A1 | 9/2013 | Cain et al. |
| 2014/0027124 | A1 | 1/2014 | Cain et al. |

SYSTEM FOR CONVEYING FLUID FROM AN OFFSHORE WELL

BACKGROUND

Drilling offshore oil and gas wells includes the use of offshore platforms for the exploitation of undersea petroleum and natural gas deposits. In deep water applications, floating platforms (such as spars, tension leg platforms, extended draft platforms, dynamically positioned platforms, and semi-submersible platforms) are typically used. One type of offshore platform, a tension leg platform ("TLP"), is a vertically moored floating structure used for offshore oil and gas production. The TLP is permanently moored by groups of tethers, called tension legs, that eliminate virtually all vertical motion of the TLP. Another type of platform is a spar, which typically consists of a large-diameter, single vertical cylinder extending into the water and supporting a deck. Spars are moored to the seabed like TLPs, but whereas a TLP has vertical tension tethers, a spar has more conventional mooring lines.

Offshore platforms typically support risers that extend from one or more wellheads or structures on the seabed to the platform on the sea surface. The risers connect the subsea well with the platform to protect the fluid integrity of the well and to provide a fluid conduit between the platform and the wellbore.

Risers that connect the surface wellhead on the platform to the subsea wellhead can be thousands of feet long and extremely heavy. To prevent the risers from potentially buckling under their own weight or placing too much stress on the subsea wellhead, upward tension is applied, or the riser is lifted, to support a portion of the weight of the riser. Since offshore platforms often move due to wind, waves, and currents, for example, the risers are tensioned such that the platform can move relative to the risers. To that end, the tensioning mechanism often exerts a substantially continuous tension force on the riser.

Risers can be tensioned by using buoyancy devices that independently support the riser, which allows the platform to move up and down relative to the riser. This isolates the riser from the heave motion of the platform and eliminates any increased riser tension caused by the horizontal offset of the platform in response to the marine environment. This type of riser is referred to as a freestanding riser.

Hydro-pneumatic tensioner systems are another type of a riser tensioning mechanism. In this type of system, a plurality of active hydraulic cylinders with pneumatic accumulators is connected between the platform and the riser to provide and maintain the desired riser tension. The platform's displacement, which may be due to environmental conditions, that causes changes in riser length relative to the platform are compensated by the tensioning cylinders adjusting for the movement.

Floating platforms, which are used for deeper drilling and production, often encounter additional challenges, such as thermal expansion, due to the fact that the drilling extends into very high temperature formations where special drilling equipment may be required. At high temperatures, the riser, which extends from the sea floor, is subject to expansion and contraction. And that expansion and contraction of the production/drilling riser may result in undesirable movement, such as buckling, in response to temperature changes.

BRIEF DESCRIPTION OF THE DRAWINGS

A better understanding of the various disclosed system and method embodiments can be obtained when the following detailed description is considered in conjunction with the drawings, in which.

DETAILED DESCRIPTION

Figure 1:
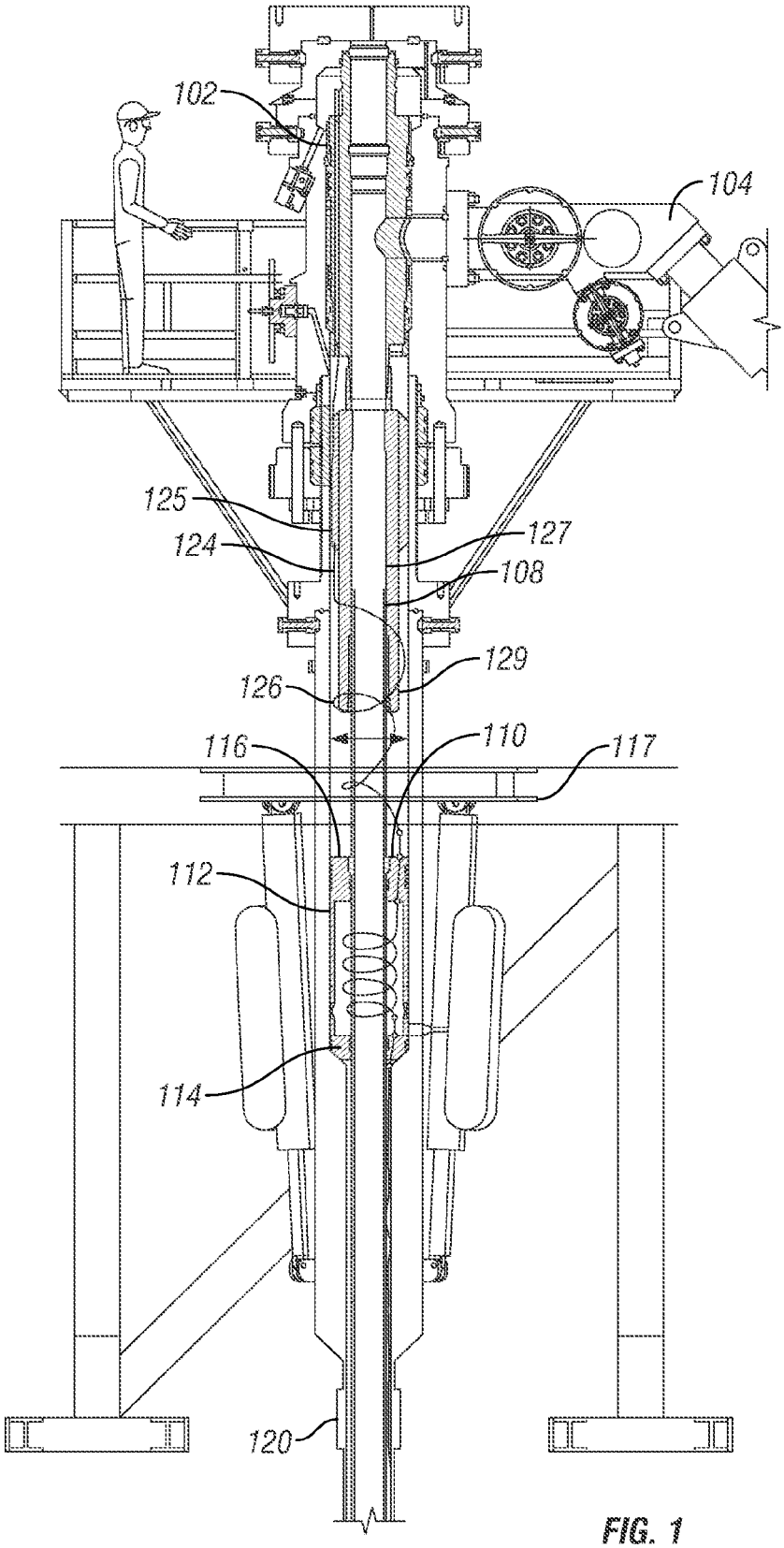
FIG. 1 is an illustrative, production riser system for elevated temperatures with completion landed.

The following discussion is directed to various embodiments of the invention. The drawing figures are not necessarily to scale. Certain features of the described embodiments may be shown exaggerated in scale or in somewhat schematic form, and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed below may be employed separately or in any suitable combination to produce desired results. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description, and claims to refer to particular features or components. As one skilled in the art will appreciate, different persons may refer to the same feature or component by different names. This document does not intend to distinguish between components or features that differ in name but not function.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis.

Disclosed herein is a system for conveying fluid from a subsea well to a floating platform. The system includes a subsea wellhead, and an outer tubing connected at a lower end and supported in tension at the upper portion by the floating platform. Inner tubing is also included. The inner tubing is connected at a lower end to the subsea wellhead and is dynamically supported in tension at an upper end by the outer tubing so that the inner tubing can move relative to the outer tubing.

An embodiment of the system c facilitate production of fluid from a subsea well to a floating platform. The system includes a subsea wellhead, a production riser connected at a lower end to the subsea wellhead and supported in tension at an upper portion by the floating platform. A production tubing, a production tree, and a tubing hanger are also included in this embodiment. The production tubing is connected at a lower end to the subsea wellhead and dynamically supported in tension at an upper end by the production riser so as to be capable of movement relative to the production riser. The production tree is fixed to the upper portion of the production riser. The tubing hanger is landed in and supported by the production tree with the production tubing being in fluid communication with the tubing hanger while being dynamically supported for movement relative to the tubing hanger.

FIG. 1 illustrates an embodiment of such a production riser for elevated production fluid temperatures. The production riser system includes a production riser 120 connected with a subsea wellhead (not shown). A production tubing 108 extends within the production riser 120 and is in fluid communication with the production fluids from the well. A dynamic tensioner 112 maintains the production riser 120 in tension as the floating platform 317 moves. The production riser system also includes a production tree 104 installed on the upper end of the production riser 120. The production tree 104 control the flow of fluids into and out of the well, and can be a vertical or horizontal "spool" tree. As shown, the production tree 104 is a horizontal tree.

The production tree 104 supports a tubing hanger 102 that is in fluid communication with the production tubing 108. And that production tubing 108 is dynamically supported for movement relative to the tubing hanger 102, as explained below. The production tubing 108 further includes a slip connector 124 at a position along the length of the inner tubing. Although the slip connector 124 is shown near the upper portion of the riser system, the connector can be located in the center of the riser or even at the lower subsea portion of the production riser system.

The slip connector 124 includes an overshot tubing 125 that includes an open lower end and internal volume. A polished bore rod (PBR) 110 in fluid communication with the well below the overshot tubing extends into the internal volume of the overshot tubing through the overshot tubing's open lower end and is movable within the overshot tubing. The overshot tubing also includes a centralizer 127 for centering the overshot tubing within the production riser 120. The overshot tubing also includes a dynamic seal 129 for sealing against the outside of the PBR as explained further below. The centralizer centralizes the overshot tubing within the production riser 120 for easier insertion of the PBR into the overshot tubing without damaging the overshot tubing's dynamic seal against the PBR.

Figure 2:
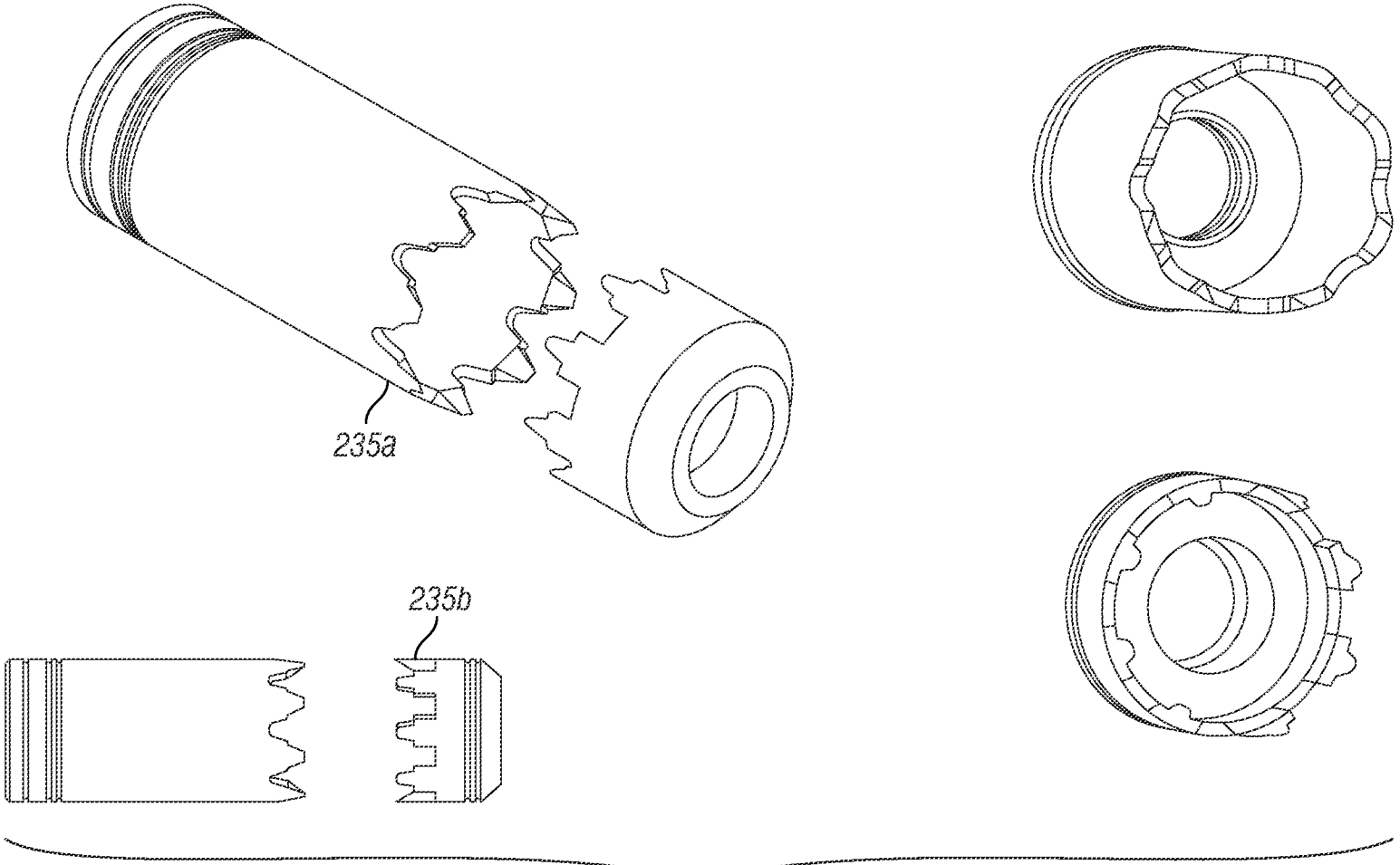
FIG. 2 is an embodiment of an annular tensioner with castellated gathering fingers.

The system for conveying fluids further includes an outer tubing with an internal shoulder, an inner tubing with an external shoulder, and an annular tensioner landed on both the outer tubing internal shoulder and the inner tubing external shoulder. The annular tensioner is movable to dynamically support the production tubing in tension. As shown in the embodiment of a production riser system, the annular tensioner 112 includes a tension plug 114 surrounding the production tubing with an outer diameter larger than the inner diameter of the production riser internal shoulder. The annular tensioner 112 also includes a tension piston 116 surrounding the production tubing with an inner diameter less than the outer diameter of the production tubing external shoulder. The tension plug 114 and tension piston 116 are located in the production riser and seal against the inside of the production riser and the outside of the production tubing to form a sealed chamber. The tension piston 116 is movable within the production riser with respect to the tension plug 114 from pressure in the sealed chamber as the production tubing moves relative to the production riser. Both the tension piston 116 and the tension plug 114 include castellated gathering fingers 235*a* and 235*b* for coupling to each other, as illustrated in FIG. 2. The castellated gathering fingers on both the tension plug 114 and the tension piston 116 include an angled ramp area. These angled ramps gather the control lines inside the sealed chamber to avoid pinching as the tensioner plug 114 and the tensioner piston 116 come together.

As shown in FIG. 1, the tension piston 116, when initially installed, may rest on the tension plug 114, and be designed to place the production tubing in tension. One option thus includes landing in tension. However, another option includes applying pressure to the annular tensioner 112 sealed chamber and holding that tubing 108 in tension.

The production riser itself could be several hundred to several thousand feet. The tension piston rests on the tension plug, which rests on tension joint that is supported by the dynamic tensioner on the platform. The top of the tension joint is pulled up, and the bottom of the tension joint is pushed down; and the tension joint body goes into tension, but sums to zero. The external tensioner setting is established to keep the external riser pipe 120 in tension. This is accomplished with sufficient tensioner setting to keep the production riser 120 in tension.

For installation, the production riser is attached to the subsea wellhead and set up in tension using the dynamic tensioner. The production tubing is then run in and attached to the subsea wellhead. When enough of the production tubing is installed, the annular tensioner components are installed and the production tubing is placed in tension. Completion related control lines 126 are run through the tension piston 116, coil around the production tubing inside the sealed chamber and then exit the tension plug 114. Penetrations are sealed with fittings, lines are continuous, and the coils allow the necessary movement up and down of the tension piston. The various control lines 126 are used to operate various valves in the permanently installed subsea piping.

Finally, the PBR is attached to the production tubing and the tubing hanger 102 and overshot assembly is lowered into the production tree allowing the overshot to swallow the PBR 110. The blowout preventer is then removed, all control lines 126 are finalized, and tree 104 is capped.

Figure 3:
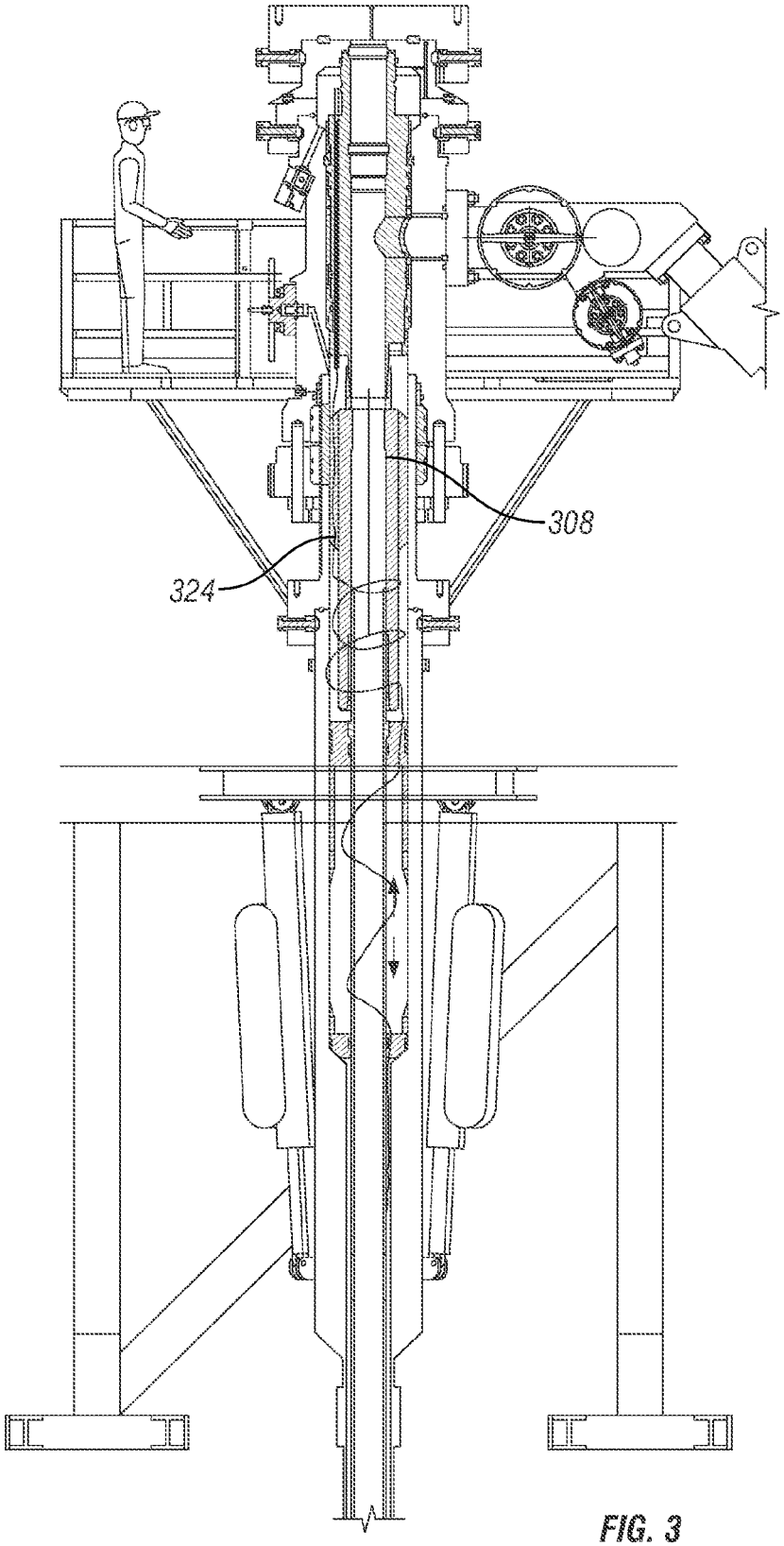
FIG. 3 is an illustrative, production riser system with production in operation at elevated temperatures.

FIG. 3 illustrates a production riser system operating with production fluid at elevated temperatures. Here, the tubing 308 has expanded in length due to heating. The overshot connector 324 helps to accommodate the expanded tubing 308 while maintaining the dynamic seal with the PBR. The annular tensioner sealed chamber pressure supply is at a level sufficient to move the tension piston upwards with the production tubing outer shoulder and thus hold the production tubing in tension despite the upward movement. Alternatively, a pressure supply may maintain the pressure in the sealed chamber so as to place enough force on the tension piston to keep the production tubing in tension. The necessary pressure in the sealed chamber may be determined based on measurements of a characteristic of the sealed chamber, such as pressure, temperature, or position of the production tubing.

There are multiple advantages to the presented invention. One main advantage is that the floating structure buoyancy needs are reduced, along with the tensioner system capacity. Normally, a subsea, wellhead tubing hanger carries significant tubing loads. Further, this system allows the external riser to stay in tension with standard external tensioner approach. This system may also be used to support a drilling riser with an inner pipe requirement. Overall, it is important to note that this exemplary system supports the inner pipe in tension, avoids compression, and avoids buckling by use of an the annular tensioner. Finally, all seals and annuli may be monitored from the floating structure deck.

Figure 4:
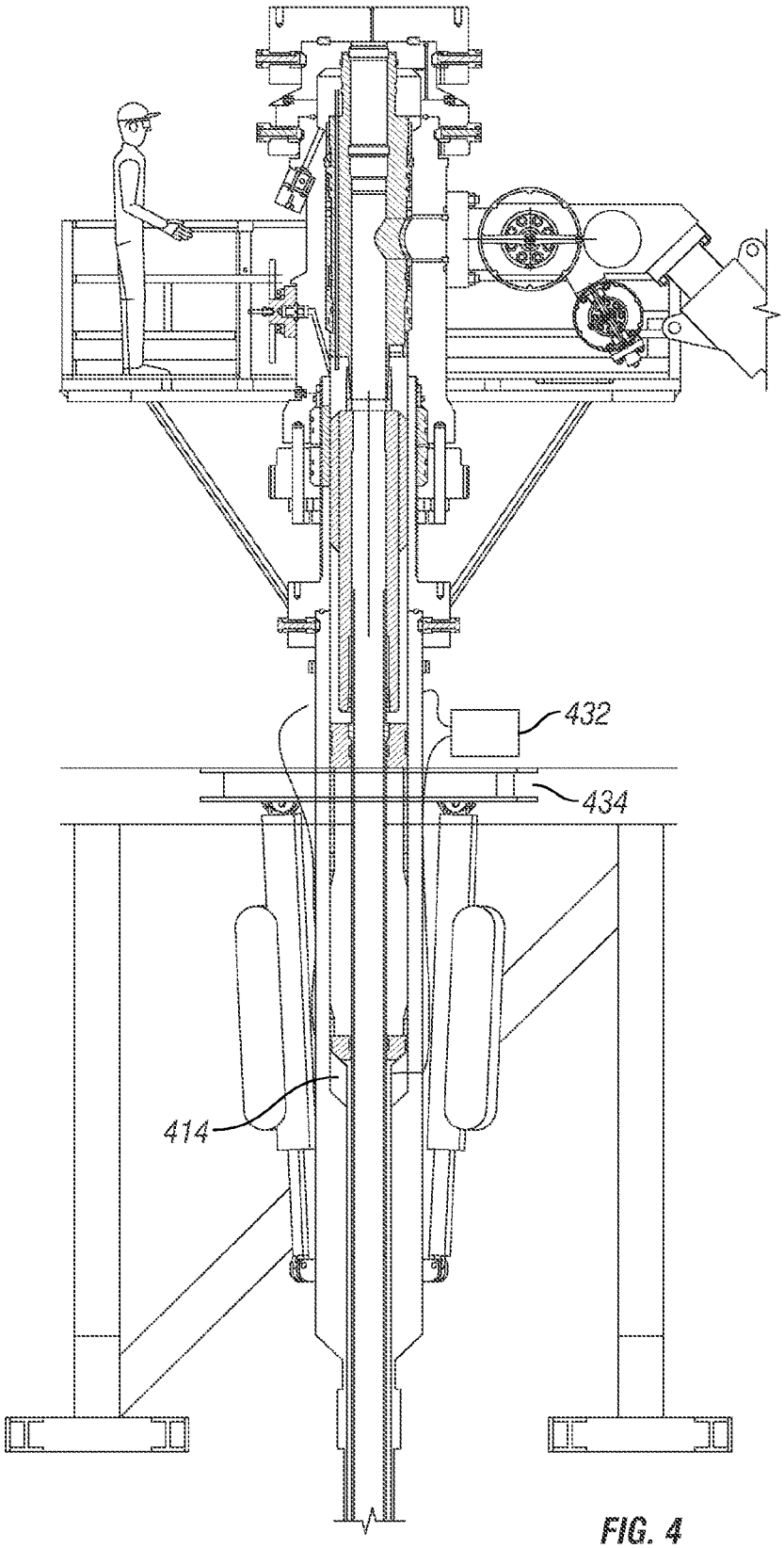
FIG. 4 is an illustrative, production riser system with control lines running outside the annular tensioner space.

As discussed above, there are various options for configuration and the use of multiple components. Another advantage of the present invention is the ability to employ several methods for not requiring the down hole lines to penetrate the annular tensioner space. The control lines would simply exit the tension joint, radially by several methods. FIG. 4 shows a method which could have a taller tension plug 414 with several radial line exits for hydraulic service. This solution does not address the optical line. This option does not require the use of orientation of the tension plug to the tension joint because each subsequent line is ported stacking up the plug. In other words, once the tension plug is in place, the tension plug porting and the tension joint porting would line up without orientation. A control, monitoring, and injection lines manifold 432 would be positioned upon the TLP deck 434. An advantage of this embodiment would be the elimination of penetration through the annular tensioner space in the riser system, which normally would require numerous control, monitoring, or injection lines.

Another alternative would allow direct connection of the control lines, but also require orientation of the plug with respect to the tension joint. A port can be coupled directly to a control line. By "direct," it is intended to include a connection or coupling between a control line and a port that does not requires annular seals that are used to seal annular zones. A control, monitoring, and injection lines manifold 432 would be positioned upon the TLP deck 434. The advantage of this embodiment would be the elimination of penetration through the annular tensioner space in the riser system, which normally would require numerous control, monitoring, or injection lines. This could be a solution on dual barrier drilling riser or on elevated temperature production risers. As an added feature, the system will include control and other down-hole hydraulic and/or fiber-optic lines without sharing space with an annular tensioner feature.

Another embodiment is also included in the present invention. This embodiment is a drilling riser system connected to a wellhead located at a seafloor. The drilling riser system includes an external riser for a floating structure with an external tensioner keeping the external riser pipe in tension. The drilling riser system also includes an internal riser with an overshot slip connector and annular tensioner as described above. The drilling riser system is such that the outer and inner drilling risers allow passage of a drill bit and drill string through the riser to the subsea well.

Figure 5:
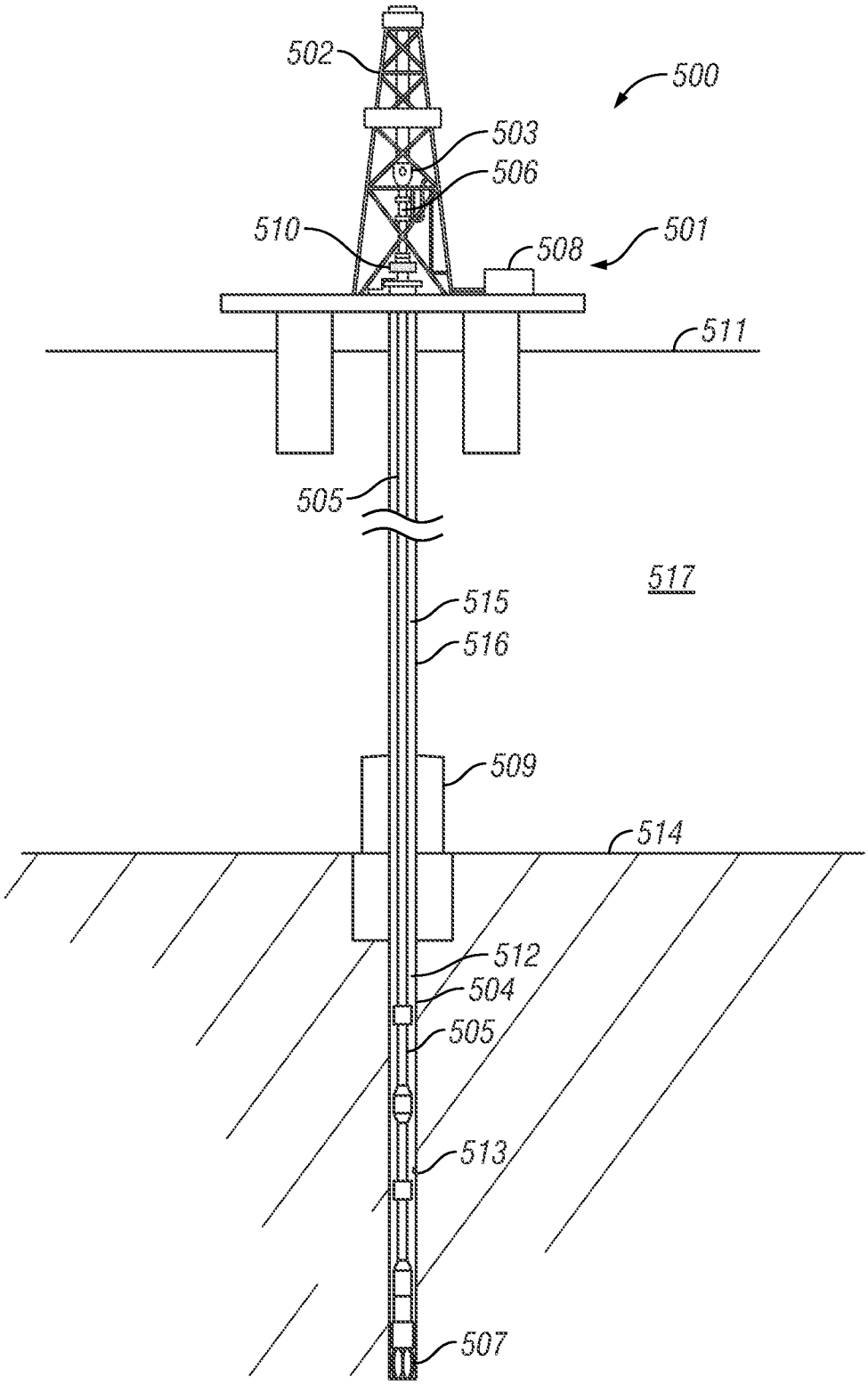
FIG. 5 is an illustrative offshore drilling system in accordance with various embodiments.

Referring now to FIG. 5, a schematic view of an offshore drilling system 500 is shown. The drilling system 500 may be of any suitable configuration. For example, the drilling system 500 may be a dry BOP system and include a floating platform 501 equipped with a drilling module 502 that supports a hoist 503. Drilling of oil and gas wells is carried out by a string of drill pipes connected together by tool joints 504 so as to form a drill string 505 extending subsea from platform 501. The hoist 503 suspends a kelly 506 used to lower the drill string 505. Connected to the lower end of the drill string 505 is a drill bit 507. The bit 507 is rotated by rotating the drill string 505 and/or a downhole motor (e.g., downhole mud motor). Drilling fluid, also referred to as drilling mud, is pumped by mud recirculation equipment 508 (e.g., mud pumps, shakers, etc.) disposed on the platform 501. The drilling mud is pumped at a relatively high pressure and volume through the drilling kelly 506 and down the drill string 505 to the drill bit 507. The drilling mud exits the drill bit 507 through nozzles or jets in face of the drill bit 507. The mud then returns to the platform 501 at the sea surface 511 via an annulus 512 between the drill string 505 and the borehole 513, through subsea wellhead 509 at the sea floor 514, and up an annulus 515 between the drill string 505 and a riser system 516 extending through the sea 517 from the subsea wellhead 509 to the platform 501. At the sea surface 511, the drilling mud is cleaned and then recirculated by the recirculation equipment 508. The drilling mud is used to cool the drill bit 507, to carry cuttings from the base of the borehole to the platform 501, and to balance the hydrostatic pressure in the rock formations. Pressure control equipment such as blow-out preventer ("BOP") 510 is located on the floating platform 501 and connected to the riser system 516, making the system a dry BOP system because there is no subsea BOP located at the subsea wellhead 509. With the pressure control equipment at the platform 501, the dual barrier requirement may be met by the riser system 516 including an external riser with a nested internal riser.

Figure 6:
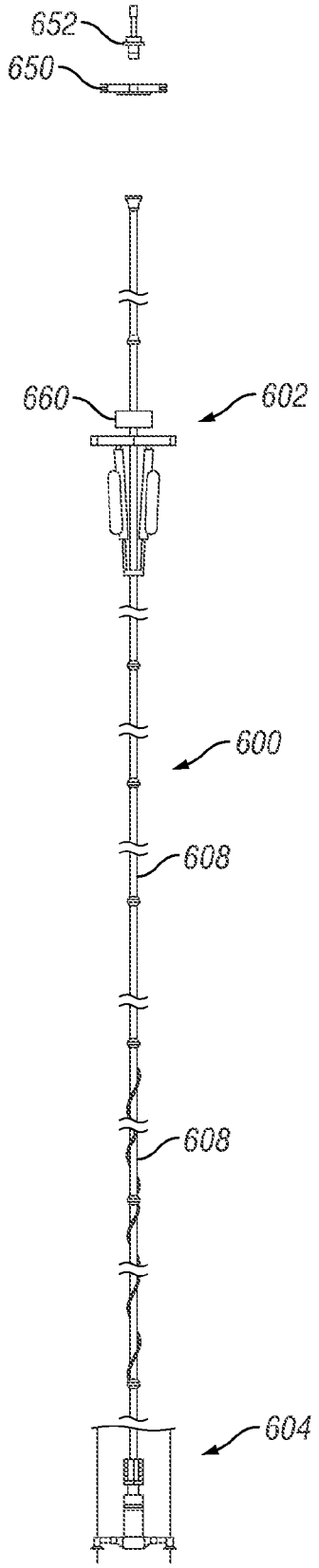
FIG. 6 is an illustrative drilling riser system including an outer riser with a nested internal riser.

As shown in FIG. 6, the external riser 600 surrounds at least a portion of the internal riser 602. The riser system is shown broken up to be able to include detail on specific sections but it should be appreciated that the riser system maintains fluid integrity from the subsea wellhead to the platform.

A nested riser system requires both the external riser 600 and the internal riser 602 to be held in tension to prevent buckling. Complications may occur in high temperature, deep water environments because different thermal expansion is realized by the external riser 600 and the internal riser 602 due to different temperature exposures-higher temperature drilling fluid versus seawater. To accommodate different tensioning requirements, independent tension devices are provided to tension the external riser 600 and the internal riser 602 at least somewhat or completely independently.

In this embodiment, the external riser 600 is attached at its lower end to the subsea wellhead 509 (shown in FIG. 5) using an appropriate connection. For example, the external riser 600 may include a wellhead connector 604 with an integral stress joint as shown. As an example, the wellhead connector 604 may be an external tie back connector. Alternatively, the stress joint may be separate from the wellhead connector 604. The external riser 600 may or may not include other specific riser joints, such as riser joints with strakes or fairings and splash zone joints 608. This embodiment also includes a surface BOP 660. Other appropriate equipment for installation or removal of the external riser 600 and the internal riser 602, such as a riser running tool 650 and spider 652 may also be located on the platform.

Figure 7:
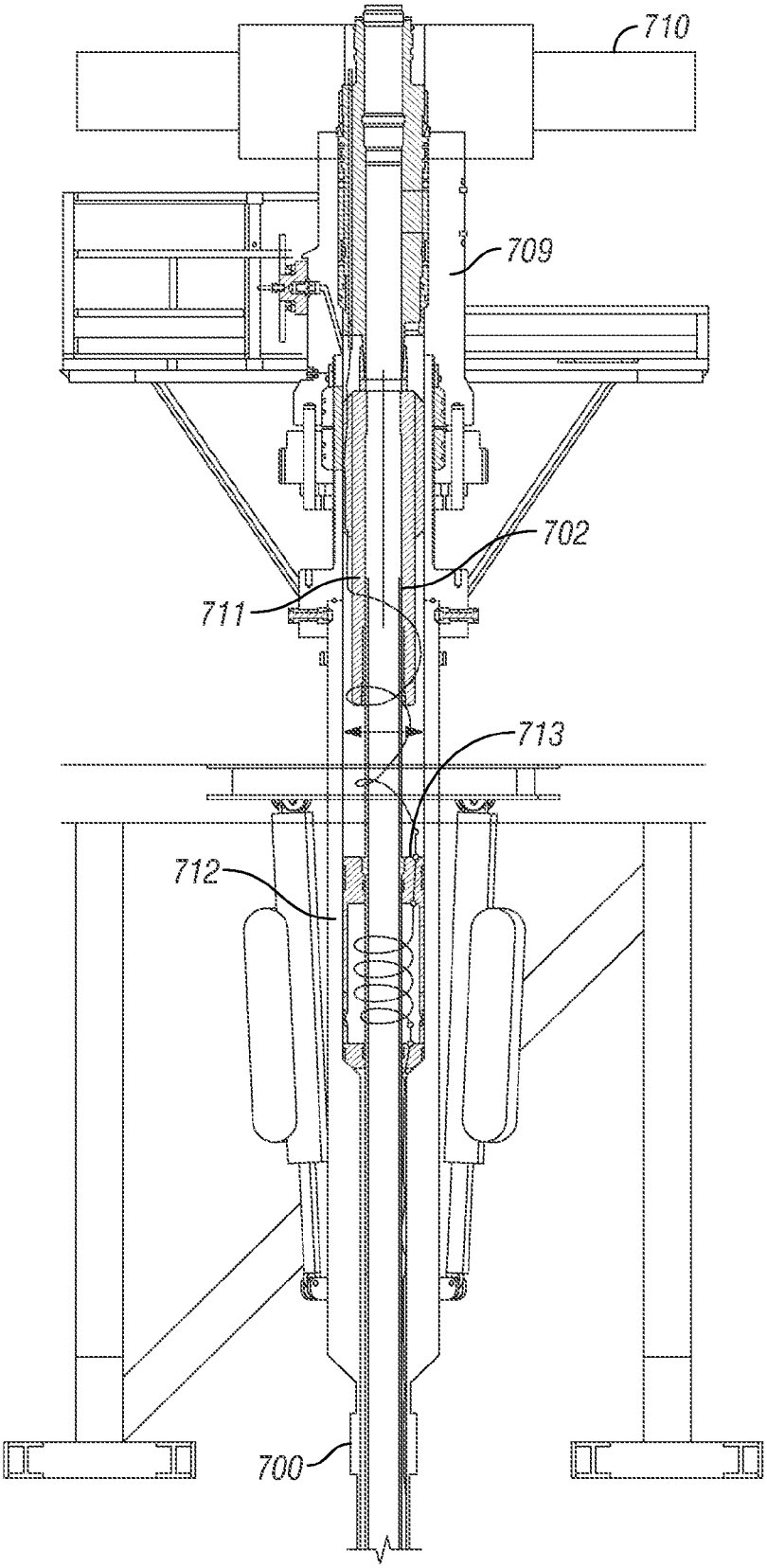
FIG. 7 is the drilling riser system of FIG. 6 with the inner riser installed within the outer riser.

As shown in FIG. 7, the drilling riser system includes the external drilling riser 700 supported by the dynamic tensioner on the platform. Extending within the external riser 700 is an internal drilling riser 702. Also included are the external shoulder on the internal drilling riser, the internal shoulder on the external drilling riser 700, and the annular tensioner. The annular tensioner 712 operates in a similar manner to the annular tensioner described above and the discussion of its operation will not be repeated.

Instead of a production tree as shown in the production system, the external riser and the internal drilling riser of the drilling riser system terminate in a surface drilling wellhead 709 which is connected to a blowout preventer 710 on the drilling platform. Appropriate connections for circulating drilling fluid, such as a diverter (not shown) that accepts the drill string for insertion through the internal drilling riser, are attached to the top of the BOP 710.

Also included as part of the internal drilling riser is the overshot slip connector 711 using the overshot tubing and PBR 713. As discussed above, the overshot slip connector allows for the movement of the internal drilling riser relative to the external riser due to thermal expansion. The annular tensioner maintains the internal riser in tension during such movement so as to avoid buckling.

Other embodiments of the present invention can include alternative variations. These and other variations and modifications will become apparent to those skilled in the art once the above disclosure is fully appreciated. It is intended that the following claims be interpreted to embrace all such variations and modifications.

We claim:

1. A method for tensioning an outer riser and inner riser from a subsea wellhead to a floating platform, comprising:
- supporting the outer riser in tension at an upper end from the floating platform; and
- continuously dynamically supporting the inner riser in tension at an upper end from the outer riser, such that the inner riser is capable of movement relative to the outer riser when supported.

2. The method of claim 1, wherein the inner riser is capable of telescoping within the outer riser.

3. The method of claim 1, wherein the outer riser comprises a production riser and the inner riser comprises a production string.

4. The method of claim 3, further comprising:
- affixing a production tree to an upper portion of the production riser; and
- landing a riser hanger in the production tree, wherein the production riser is in fluid communication with the riser hanger while being dynamically supported for movement relative to the riser hanger.

5. The method of claim 1, wherein the outer riser comprises an outer drilling riser and the inner riser comprises an inner drilling riser, the method further comprising positioning a drill string within the inner drilling riser and conducting drilling operations.

6. The method of claim 5, further comprising positioning a blowout preventer at the floating platform.

7. The method of claim 1, further comprising:
- positioning a slip connector at a position along the length of the inner riser, the slip connector comprising:
  - an overshot riser including an open lower end and internal volume; and
  - a polished bore rod ("PBR") extending into the internal volume of the overshot riser through the overshot riser open lower end and movable within the overshot riser.

8. The method of claim 7, wherein the overshot riser includes a rigid centralizer.

9. The method of claim 8, wherein the overshot riser includes a dynamic seal for sealing against the PBR.

10. The method of claim 1, wherein the outer riser comprises an internal shoulder and the inner riser comprises an external shoulder, the method further comprising landing an annular tensioner on both the outer riser internal shoulder and the inner riser external shoulder, the annular tensioner being movable to dynamically support the inner riser in tension.

11. The method of claim 10, wherein the annular tensioner comprises:
- a tension plug surrounding the inner riser with an outer diameter larger than the inner diameter of the outer riser internal shoulder;
- a tension piston surrounding the inner riser with an inner diameter less than the outer diameter of the inner riser external shoulder;
- the tension plug and tension piston being located in the outer riser and sealing against the outer riser and the inner riser to form a sealed chamber; and
- the tension piston being movable within the outer riser with respect to the tension plug from pressure in the sealed chamber as the inner riser moves relative to the outer riser.

12. The method of claim 11, wherein supporting the outer riser in tension comprises supporting the outer riser with a dynamic tensioner.

13. A method for tensioning an outer riser and inner riser from a subsea wellhead to a floating platform, comprising:
- connecting the outer riser at an upper end to a floating platform so as to support the outer riser in tension from the subsea wellhead; and
- connecting the inner riser at an upper end to the outer riser so as to continuously and dynamically support the inner riser in tension from the subsea wellhead,
- wherein the inner riser is capable of movement relative to the outer riser when connected.

14. The method of claim 13, wherein the inner riser is capable of telescoping within the outer riser.

15. The method of claim 13, wherein the outer riser comprises a production riser and the inner riser comprises a production string.

16. The method of claim 15, further comprising:
- affixing a production tree to an upper portion of the production riser; and
- landing a riser hanger in the production tree, wherein the production riser is in fluid communication with the riser hanger while being dynamically supported for movement relative to the riser hanger.

17. The method of claim 13, wherein the outer riser comprises an outer drilling riser and the inner riser comprises an inner drilling riser, the method further comprising positioning a drill string within the inner drilling riser.

18. The method of claim 17, further comprising positioning a blowout preventer at the floating platform.

19. The method of claim 13, further comprising:
- positioning a slip connector at a position along the length of the inner riser, the slip connector comprising:
  - an overshot riser including an open lower end and internal volume; and
  - a polished bore rod ("PBR") extending into the internal volume of the overshot riser through the overshot riser open lower end and movable within the overshot riser.

20. The method of claim 13, wherein the outer riser comprises an internal shoulder and the inner riser comprises an external shoulder, the method further comprising landing an annular tensioner on both the outer riser internal shoulder and the inner riser external shoulder, the annular tensioner being movable to dynamically support the inner riser in tension.

21. The method of claim 20, wherein the annular tensioner comprises:

a tension plug surrounding the inner riser with an outer diameter larger than the inner diameter of the outer riser internal shoulder;

a tension piston surrounding the inner riser with an inner diameter less than the outer diameter of the inner riser external shoulder;

the tension plug and tension piston being located in the outer riser and sealing against the outer riser and the inner riser to form a sealed chamber; and the tension piston being movable within the outer riser with respect to the tension plug from pressure in the sealed chamber as the inner riser moves relative to the outer riser.

* * * * *